US006988631B1

(12) United States Patent
Brothers

(10) Patent No.: US 6,988,631 B1
(45) Date of Patent: Jan. 24, 2006

(54) COVERED DISHWARE

(76) Inventor: Richard G. Brothers, 4729 Alameda Ave., Las Vegas, NV (US) 89110

( * ) Notice: Subject to any disclaimer, the term of this patent is extended or adjusted under 35 U.S.C. 154(b) by 374 days.

(21) Appl. No.: 10/604,347

(22) Filed: Jul. 14, 2003

Related U.S. Application Data

(62) Division of application No. 09/965,496, filed on Sep. 26, 2001, now Pat. No. 6,726,049.

(60) Provisional application No. 60/235,482, filed on Sep. 26, 2000.

(51) Int. Cl.
*A47G 19/00* (2006.01)

(52) U.S. Cl. ..... 220/574

(58) Field of Classification Search ..... None
See application file for complete search history.

(56) References Cited

U.S. PATENT DOCUMENTS

| | | | | |
|---|---|---|---|---|
| 1,281,922 A | | 10/1918 | Fairbanks | |
| 2,461,711 A | | 2/1949 | Wewetzer | |
| 3,060,838 A | | 10/1962 | Priore | |
| RE28,720 E | * | 2/1976 | Sedlak | 206/501 |
| 4,197,940 A | * | 4/1980 | DeRossett | 220/780 |
| 4,893,771 A | | 1/1990 | Kaneshiro | 248/176 |
| 4,936,536 A | | 6/1990 | Meneghello | 248/309.1 |
| 5,020,684 A | | 6/1991 | Jow | 220/4.24 |
| 5,553,531 A | | 9/1996 | Brown | 99/340 |
| 5,771,779 A | | 6/1998 | Stein | 99/323.7 |
| D398,483 S | | 9/1998 | Stocco | D7/601 |

* cited by examiner

*Primary Examiner*—Stephen Castellano
(74) *Attorney, Agent, or Firm*—John C. Lambertsen; Kenehan & Lambertsen, Ltd.

(57) ABSTRACT

A covered food container or serving platter incorporates a cover stand as part of the structure of the container. The cover may be temporarily stored on the stand while the user obtains access to the container. In one embodiment a central support extends from the serving platter and receives a central support shaft formed within the cover. When the cover is resting upon the platter, the shaft is fully received within the central support. As the cover is raised, the support shaft follows, and is gradually withdrawn from the central support. Projecting cam lobes are formed in a longitudinal manner on the surface of the support shaft, and support shaft stops project inwardly from the outer walls of the central support near the upper opening thereof. The cam lobes cooperate with the shaft stops to either permit the withdrawal of the support shaft from the central support or, if the cover is twisted to a different radial positioning of the cam lobes, the support shaft stops will permit the support shaft to rest upon them, thus supporting the cover in an up-raised position with respect to the serving platter.

6 Claims, 9 Drawing Sheets

Fig. 1
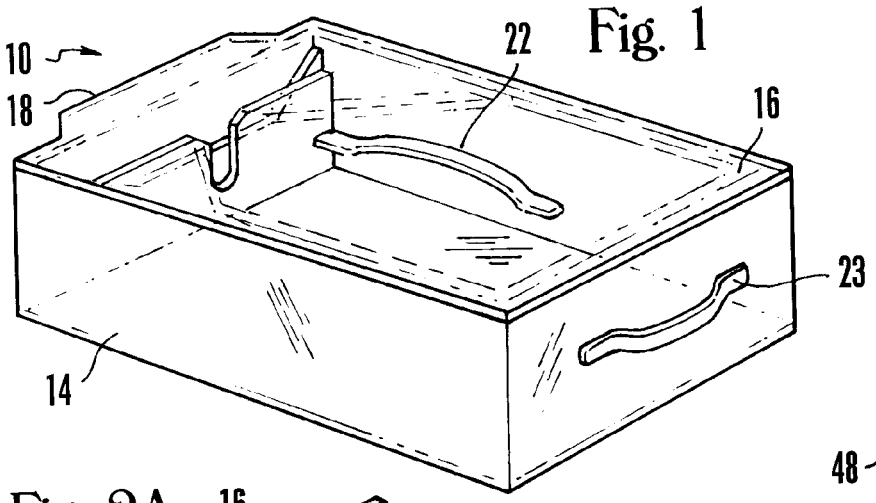
Fig. 2A
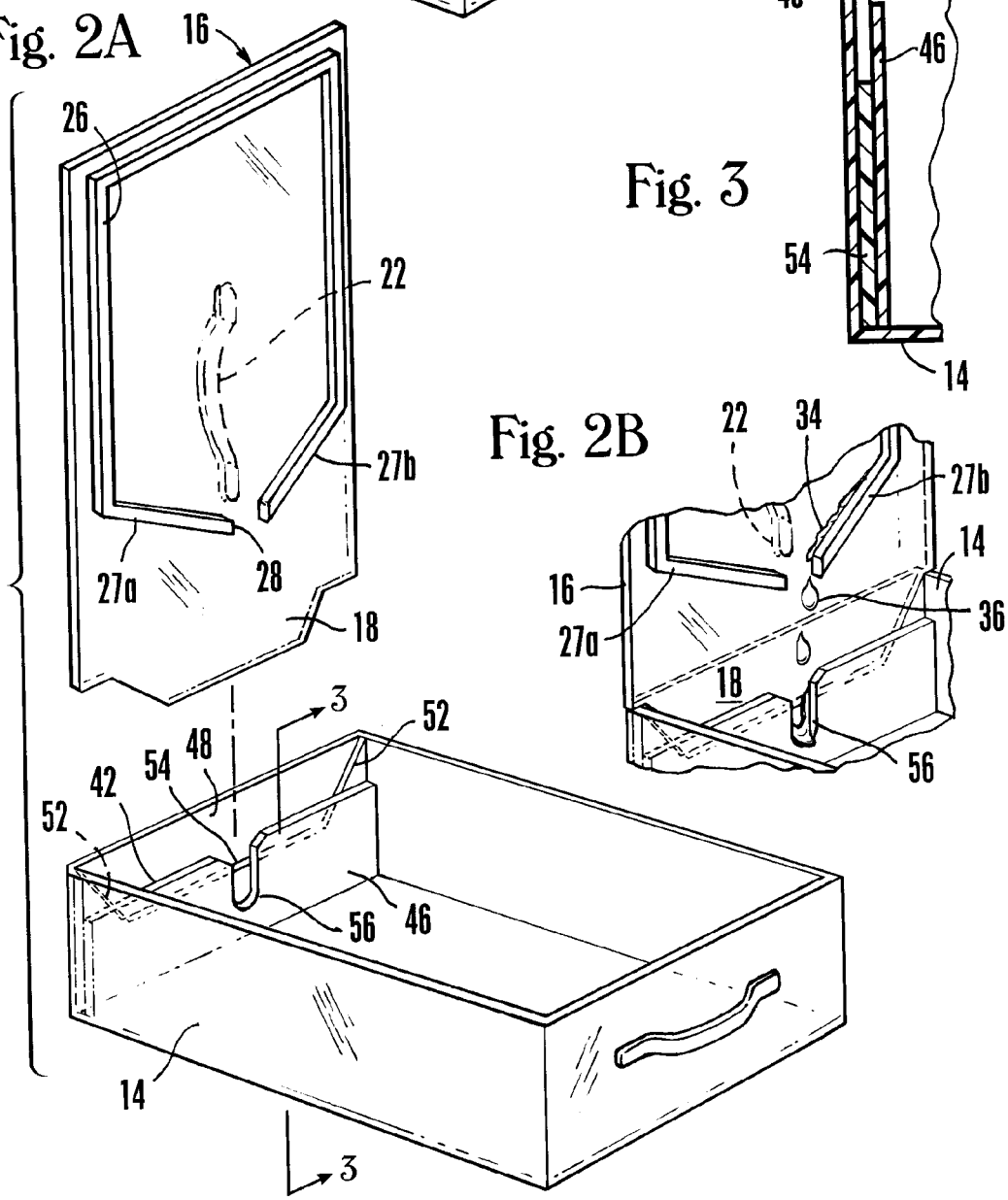
Fig. 3
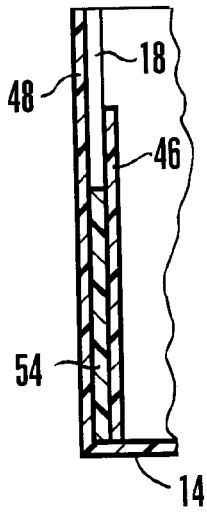
Fig. 2B

Fig. 9
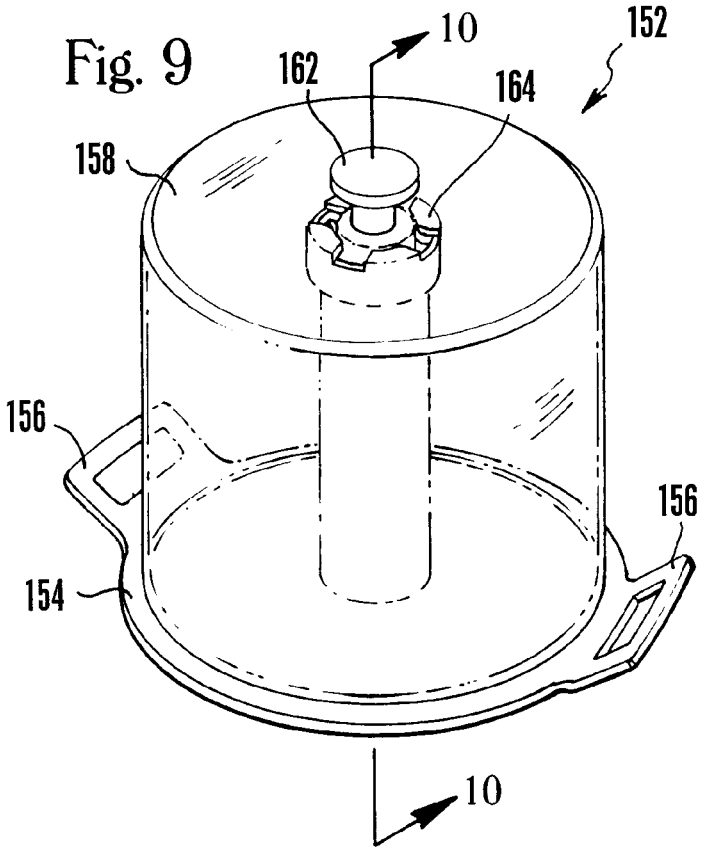
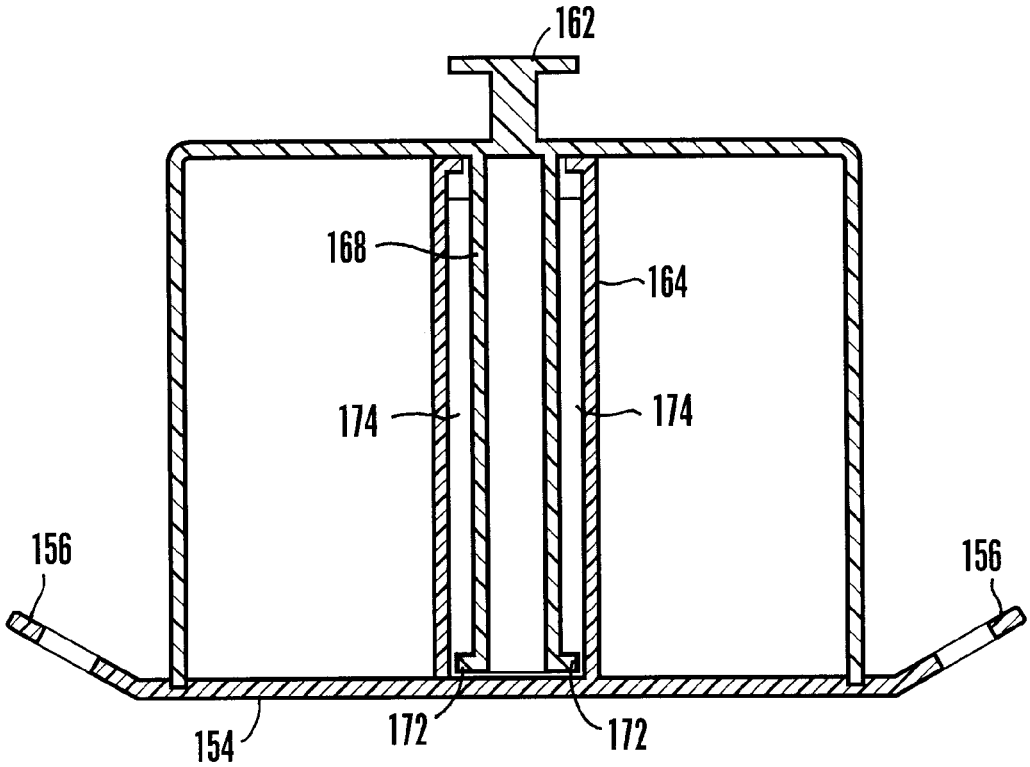
Fig. 10A

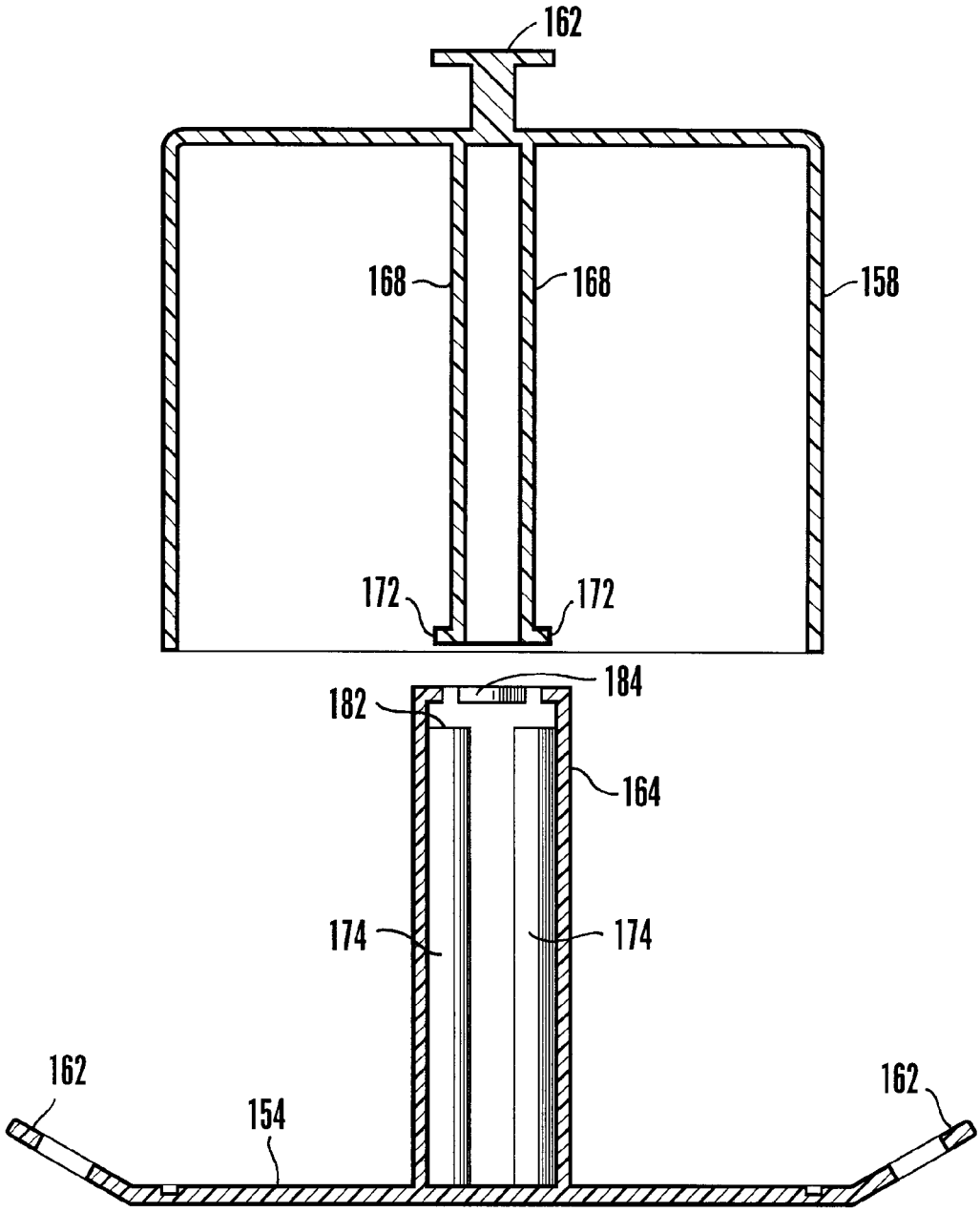
Fig. 10B
Fig. 11A
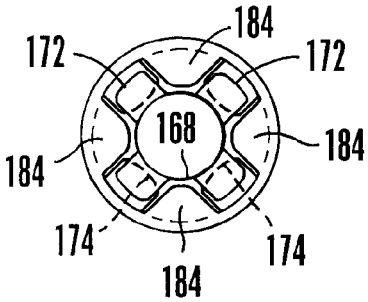
Fig. 11B
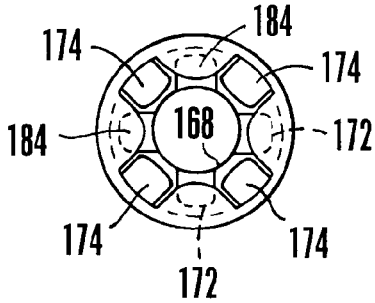

COVERED DISHWARE

CROSS REFERENCE TO RELATED APPLICATIONS

This application is a divisional of application Ser. No. 09/965,496, filed Sep. 26, 2001, now U.S. Pat. No. 6,726,049, which claims the benefit of U.S. Provisional Application Ser. No. 60/235,482, filed Sep. 26, 2000.

BACKGROUND OF INVENTION

1. Field of the Invention

The present invention relates to food containers and, more particularly, to such containers having a removable cover. More specifically, the present invention relates to covered food containers wherein a structural feature of the container receives a matching structural component of the cover to provide a temporary resting location for the cover when access to the Interior of the container is required.

2. Description of the Prior Art

The ideal of a "family dinner" where all members of a family gather at a certain time to enjoy conversation during a relaxed meal continues on the endangered list. Existing more in memory than in fact, dinnertime in most families will extend over an ill-defined period of time, with members eating as the opportunity arises. Covered dishware enables cooked food to be enjoyed at a later time, without worry of exposure to airborne germs or of the food drying out.

Covers for dishware also provide these same services for group gatherings, whether at holidays or at potluck events. In both instances, the food is prepared at an earlier time, and is then stored and later re-heated at the time it is served (or re-served). At those events where seconds (or even thirds!) are the norm, covers are essential towards maintaining the food in an appetizing and safe condition.

In most instances, covers are not directly connected to the dishware or other container with which they are used. As a result, covers can be misplaced when in storage. Covers also present a problem at the time of food service. For self-service events, it becomes awkward to raise and hold the cover, hold the serving utensil, and hold the plate upon which the food is received. Consequently, it is the custom to remove all of the covers just prior to food service, and then replace them after all parties have passed through the food line.

Finding space for all of these covers can be difficult, and typically they are removed from the area and all piled together. This makes their replacement more difficult, and thus less likely to occur, to the detriment of food quality. A need exists for dishware having a symbiotic relationship with its respective cover. To the extent that a cover for a particular piece of dishware could remain engaged with that dishware at all times during food service, considerable savings in space and efficiency could be obtained.

SUMMARY OF INVENTION

It is an object of the present invention to provide a covered food container or serving platter that incorporates a cover stand as part of the structure of the container. A user is thereby able to temporarily store the cover upon the stand while accessing the contents of the container. The presently preferred embodiments enable such temporary storage utilizing a variety of different structures.

A STAND-A-COVER™ brand pan utilizes a retaining slot formed at each end of the pan to receive the extended portion of the cover that, when in a covering position, overlies the end handles of the container. Thus, when access to the interior of the container is desired, the cover is removed, rotated to a vertical position, and then inserted into either of the retaining slots where it remains, standing on end, until removed to once again cover the container.

The HALF-COVERED™ brand server utilizes the cover itself as a support. Two half-covers cooperate in an overlapping manner to cover a serving platter. To seal their interface, a projecting rib on one is received by a corresponding groove formed in the surface of the other. When access to the platter is required, one of the half-covers is removed, and is then placed on top of the other half-cover. The covers are so positioned that the projecting rib and receiving groove cooperate to again form a stable, nested relationship. When access to the serving platter is no longer required, the upper half-cover is lifted and rotated to a position that once again covers the previously exposed platter.

In yet a further embodiment, a TWIST-A-COVER™ brand covered dish includes a central support that extends up from the dish and a centrally located support shaft that extends down from the cover. When the cover is resting upon the dish, the shaft is fully received within the central support. As the cover is raised, the support shaft follows, and is gradually withdrawn from the central support. Projecting cam lobes are formed in a longitudinal manner on the surface of the support shaft, and support shaft stops project inwardly from the outer walls of the central support near the upper opening thereof.

The cam lobes cooperate with the shaft stops to either permit the withdrawal of the support shaft from the central support or, if the cover is twisted to a different radial positioning of the cam lobes, the support shaft stops will permit the support shaft to rest upon them, thus supporting the cover in an up-raised position with respect to the dish. When it is again desired to lower the cover, the cover is twisted to permit the cam lobes to pass between the support shaft stops as the cover is lowered.

Some further objects and advantages of the present invention shall become apparent from the ensuing description and as illustrated in the accompanying drawings.

BRIEF DESCRIPTION OF DRAWINGS

FIG. 1 is a perspective view, with portions in phantom, showing a type of covered dishware in accordance with the present invention.

FIG. 2A is an exploded perspective view, with portions in phantom, showing a manner in which a cover engages with the dishware of FIG. 1 in accordance with the present invention.

FIG. 2B is a partial, enlarged perspective view, with portions in phantom, showing the drainage path of condensate water from a cover into the dishware of FIG. 1 in accordance with the present invention.

FIG. 3 is a cross-sectional view, taken along line 3—3 in FIG. 1, showing a cover-receiving slot formed in the dishware of FIG. 1 in accordance with the present invention.

FIG. 9 is a perspective view, with portions in phantom, showing a still further alternate type of covered dishware in accordance with the present invention.

FIG. 10A is a cross-sectional view, taken along line 10—10 of FIG. 9, showing the manner in which the cover is received by the dishware of FIG. 9 in accordance with the present invention.

FIG. 10B is an exploded cross-sectional view, taken along line 10—10 of FIG. 9, showing the cover separated from the dishware of FIG. 9 in accordance with the present invention.

FIG. 11A is a plan view, with portions in phantom, showing a central support column of the dishware of FIG. 9 as positioned to permit the separation of the cover from the dishware in accordance with the present invention.

FIG. 11B is a plan view, similar to FIG. 11A, showing a central support column of the dishware of FIG. 9 as positioned to prevent the disengagement of the cover from the dishware in accordance with the present invention.

DETAILED DESCRIPTION

Figure 4:
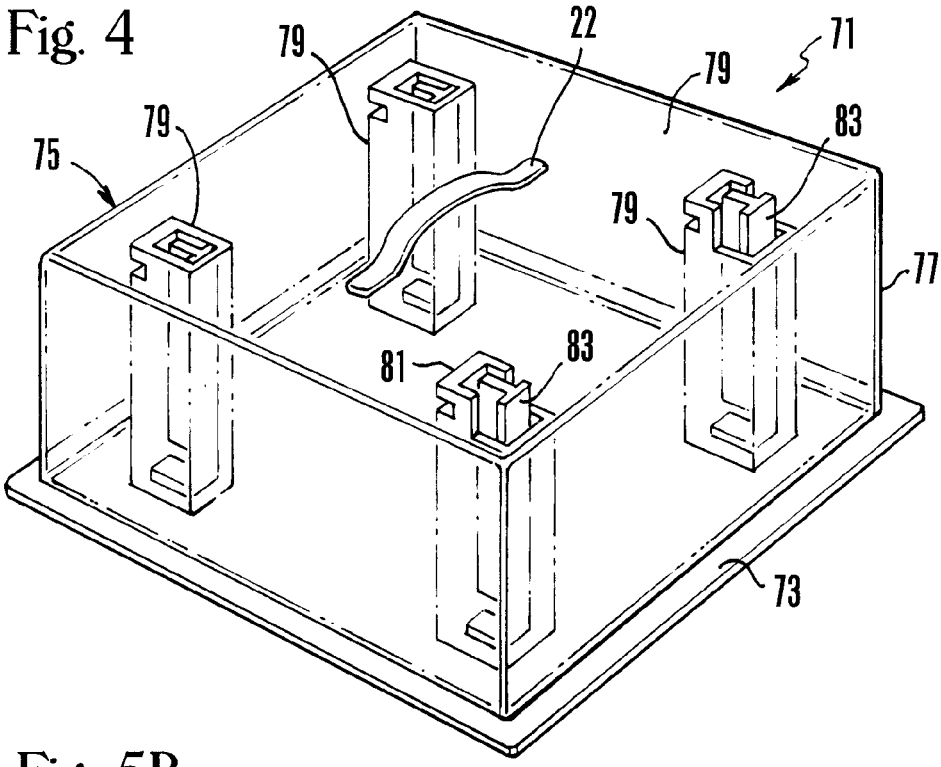
FIG. 4 is a perspective view, with portions shown in phantom, showing an alternate type of covered dishware in accordance with the present invention.

Reference is now made to the drawings, wherein like numerals refer to like parts throughout. In FIG. 1 a STAND-A-COVER™ covered pan 10 is shown, with a lower pan 14 receiving a cover 16 in a conventional manner. The edges along three of the four sides of the cover 16 are substantially aligned with the upper edges of three corresponding sides of the lower pan 14. A cover extension 18 is formed on a remaining side of the cover 16, with a portion of the cover extension 18 extending beyond an upper edge of the corresponding side of the lower pan 14. A handle 23 is provided the cover 16, and a pair of handles 22 (only one shown in FIG. 1) are preferably provided the lower pan 14.

In FIG. 2A the cover 16 has been removed from the lower pan 14 and is shown appropriately positioned to be received by the lower pan 14 for temporary storage. As so positioned, a lower surface of the cover 16 is revealed, showing a seating ridge 26 formed in and projecting from said inner surface of the cover 16 along a substantial portion of three of the sides thereof. The seating ridge 26 is recessed from the adjacent edges of the cover 16 by an amount that is roughly equivalent to the thickness of the sidewalls of the lower pan 14. As so positioned, the seating ridge 26 encourages the proper positioning of the cover 16 on of the lower pan 14 (see FIG. 1).

As is also depicted in FIG. 2A, the seating ridge 26 diverges from the adjacent edge of the cover 16 as it extends towards the cover extension 18, forming a pair of channel guides 27*a*, 27*b*. The ends of each channel guides 27*a*, 27*b* are spaced from one another forming a cover channel opening 28. Referring momentarily to FIG. 2B, the purpose for the channel guides 27*a*, 27*b* becomes readily apparent. When warm foods (not shown in the Figures) are kept within the covered pan 10 for an extended period, condensate can form on the inner surface of the cover 16.

Upon positioning the cover 16 for its temporary storage within the lower pan 14, there is a tendency for such condensate to begin flowing down the inner surface of the cover 16. The channel guides 27*a*, 27*b* are provided to guide a stream of condensate 34 towards the cover channel opening 28. In FIG. 2B, a plurality of condensate drops 36 are shown flowing from the cover channel opening 28 towards the cover extension 18.

Returning to FIG. 2A, a retaining slot 42 is formed in one end of the lower pan 14 and is configured to temporarily receive and retain the cover extension 18 of the cover 16. An inner retaining wall 46 is located within the lower pan 14 and is spaced from an outer retaining wall 48, which in turn forms one of the outer walls of the lower pan 14. The inner retaining wall 46 is sufficiently spaced from the outer retaining wall 48 to receive the cover extension 18 of the cover 16 there between.

A pair of support shoulders 52 and a raised edge support 54 are provided within the retaining slot 42 and are dimensionally configured to inversely correspond to the configuration of the cover extension 18, to better and more securely receive the cover 16. The relative positioning of the cover 16 within the retaining slot 42 is also shown by reference to FIG. 3.

Returning once again to FIGS. 2A and 2B, a drainage channel 56 is centrally formed within the inner retaining wall 46, extending to a lower relative elevation with respect to the bottom of the lower pan 14 than does the raised edge support 54. As so configured, the drainage channel 56 provides a path for the drainage of any condensate that may have accumulated on an inner surface of the cover 16 and drained onto the cover extension 18 through the cover channel opening 28. The drainage channel 56 also prevents the accumulation of any condensate within the retaining slot 42, which might otherwise provide a medium to encourage bacterial growth or increase the risk of cross-contamination.

In a presently preferred embodiment, the STAND-A-COVER™ covered pan 10 is fabricated out of plastic, generally of thickness 3/16", although other materials such as metal, glass, and wood are also acceptable, as well as are countless others, without departing from the teachings of the present invention.

When fabricated in the shape of FIGS. 1–3, an appropriate set of dimensions would be as follows: the lower pan 14 measuring 12" by 9", by 4¾" in height, with the corresponding cover 16 measuring 12" by 9", and having the cover extension 18 projecting 1¾" beyond the length that would otherwise be required of a conventional rectangular pan. The seating ridge 26 projects from the inner surface of the cover 16 approximately 5/16", and is parallel to the outer edge of the cover 16, spaced an approximate distance of ¼ inch there-from. The cover channel opening 28 can vary a great deal in dimension, with 1 ¾" presently considered suitable.

Within the lower pan 14, the inner retaining wall 46 is set ¼" from the outer retaining wall 48. The support shoulders 52 dimensionally correspond to the requirements of the cover extension 18, which it supports when the cover 16 is up-ended and placed within the retaining slot 42. Presently, the dimensions of the support shoulders 52 provide a sloping surface of 4¾" in height at the sidewall of the lower pan 14, sloping towards a minimum height of 2½" at a location 1½" inward of that sidewall. As so dimensioned, the height of the inner retaining wall 46 is 4⅛", with the u-shaped drainage channel 56 plunging 2⅛" from the top height of the inner retaining wall 46.

An alternate embodiment of the present invention is shown in FIG. 4, where an ALWAYS COVERED™ brand covered platter 71 is provided, having a platter 73 and a platter cover 75. The platter 73 is appropriately sized to receive the platter cover 75, which includes a plurality of cover sides 77 and a cover lid 79.

A plurality of support columns 81 are attached to and distributed about the platter 73 in a substantially uniform manner to form a support array for the platter cover 75. Each of the support columns 81 defines a substantially hollow interior, appropriately dimensioned to slidably receive a support extension 83. Attached to the cover lid 79, each of the support extensions 83 linearly extend from the cover lid 79 in a manner substantially parallel to the cover sides 77. The support extensions 83 are received by and interact with the support columns 81 to create an elevated support shelf from which to suspend the platter cover 75 over the platter 73.

Figure 5B:
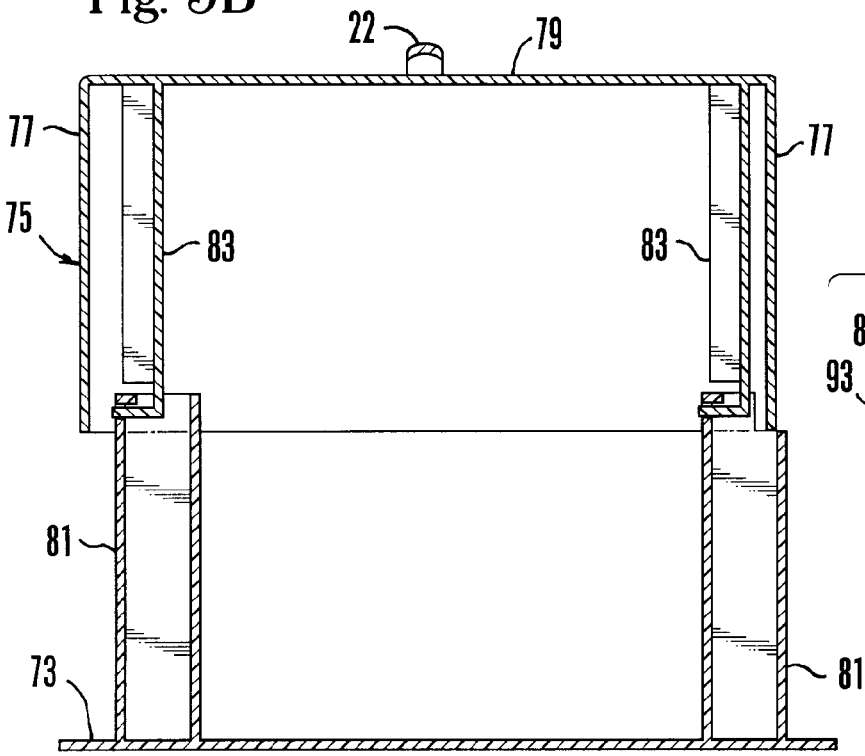
FIG. 5B is a cross-sectional view showing a manner of engagement between the dishware of FIG. 4 and a cover therefor, in accordance with the present invention.
Figure 5A:
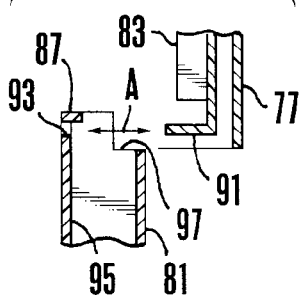
FIG. 5A is a partial exploded cross-sectional view, showing a manner of interaction between the cover and the dishware of FIG. 4 in accordance with the present invention.

The manner in which this may selectively occur is best illustrated by reference to FIG. 5A. An extension stop 87 is formed in an upper terminus of each of the support columns 81. The extension stop 87 forms a surface that is substantially parallel to that of the platter 73, and thus substantially perpendicular to the direction in which the support column 81 extends. A support foot 91 is formed at a lower terminus of the support extension 83, and extends in a direction that is substantially parallel to that of the extension stop 87.

A support aperture 93 is formed in an interior surface 95 of the support column 81 at a location that is substantially adjacent that of the extension stop 87. The support aperture 93 is sized to permit the slidable insertion and removal of the support foot 91, as is indicated by a two-headed arrow A in FIG. 5A. A cover notch 97 is formed in a pair of the support columns 81 to permit an adjacent portion of the cover side 71 to traverse an upper portion of the support column 81 as the support foot 91 is inserted and removed from the support aperture 93.

Figure 5C:
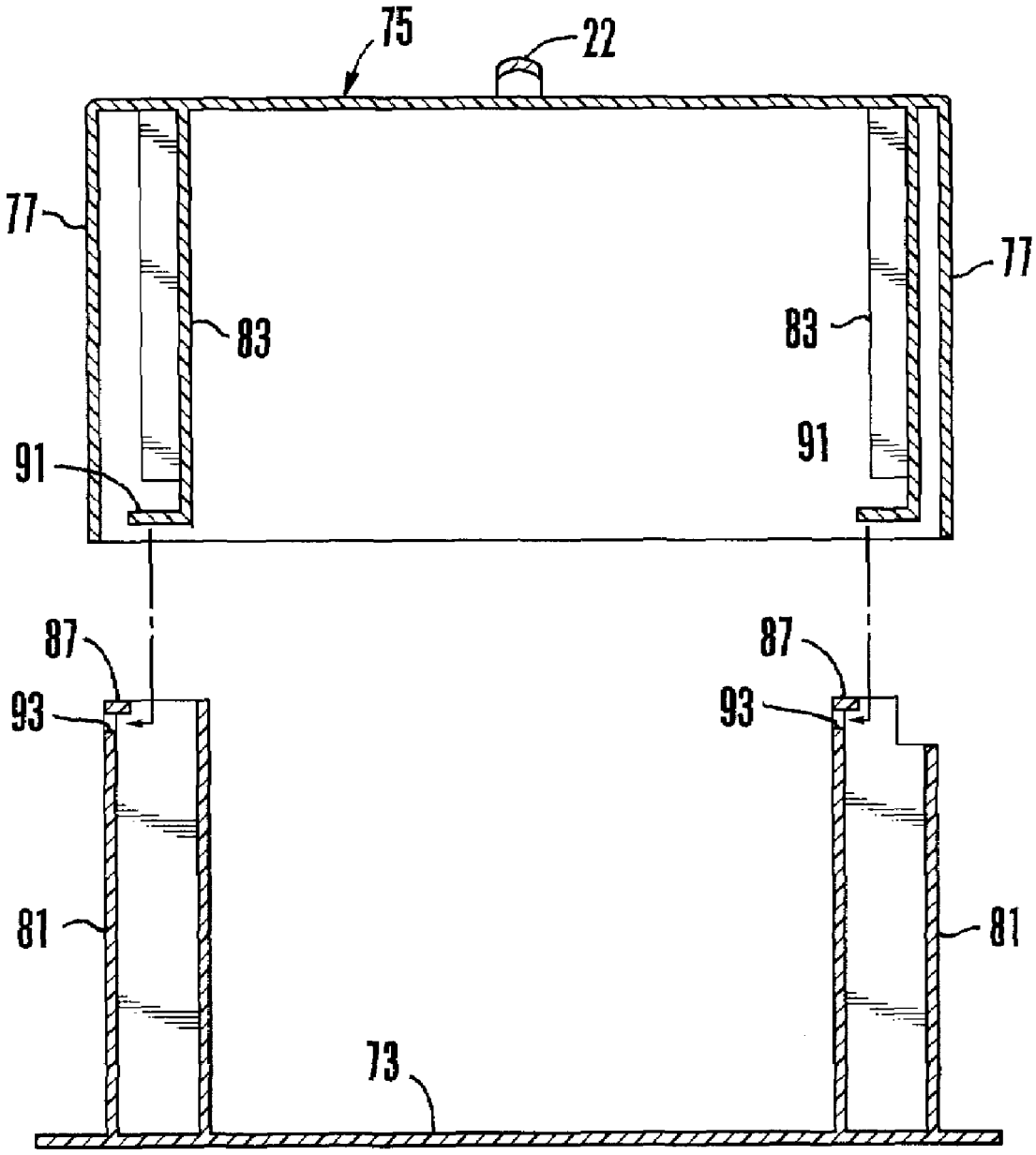
FIG. 5C is a cross-sectional view, similar to FIG. 5B, showing a manner of disengagement between the dishware of FIG. 4 and a cover therefor, in accordance with the present invention.

When in use, the platter cover 75 is lifted from its position of rest upon the platter 73 (not shown in FIG. 5A or 5B), with the support foot 91 sliding along an interior surface of the support column 81 until it reaches the support aperture 93. The extension stop 87 helps locate the support aperture 93 by preventing the inadvertent separation of the support extension 83 and the support column 81. Upon the abutment of the support foot 91 and the extension stop 87, the user may elect to either slide the support foot 91 into the support aperture 93, permitting the platter cover 75 to rest upon the support column 81 (see FIG. 5B) or to back the support foot 91 away from the support aperture 93 and the extension stop 87, allowing the platter cover 75 to be lifted and removed from the platter 73 (see FIG. 5C).

As was the case with the STAND-A-COVER™ device, the ALWAYS COVERED™ platter is preferably fabricated out of plastic of thickness ¼", although other materials such as wood, glass, and metal also are considered to be appropriate. In a particularly preferred embodiment, the covered platter 71 measures 16½" by 12½", and 8⅝" in height. Four support columns 81 are provided, and attached to the platter 73 at locations spaced approximately ¾" from the adjacent edges. The support columns 81 extend 8" from the surface of the platter 73, and measure 2½" by 1½" in cross-section.

The support extensions 83 are attached to the platter cover 75 at locations corresponding to the support columns 81 when the platter cover 75 is positioned to be received by the platter 73. The support extensions 83 are 7⅞" in length, and have a T-shaped cross-section of dimensions 1" by 1⅛".

To obtain an efficient interaction between the support columns 81 and the support extensions 83, the extension stop 87 projects from the adjacent interior surface 95 a distance of ¼", and the support aperture 93 is positioned immediately below the extension stop 87 and measures 1" by ¼". The support foot 91 is located a distance of 7⅜" from the platter cover 75 and extends a distance of ⅞" from the AT@ portion of the support extension 83. There is a gap between the support foot 91 and the support web portion of the support extension 83 measuring 1". To permit the cover sides 77 to laterally move over a portion of the top of two of the support columns 81 when the support feet 91 are being inserted into the support aperture 93, a notch is formed in one side of the support column 81 by the removal of a portion measuring 1¼" by 1¼" from the top of the support column 81.

Figure 6:
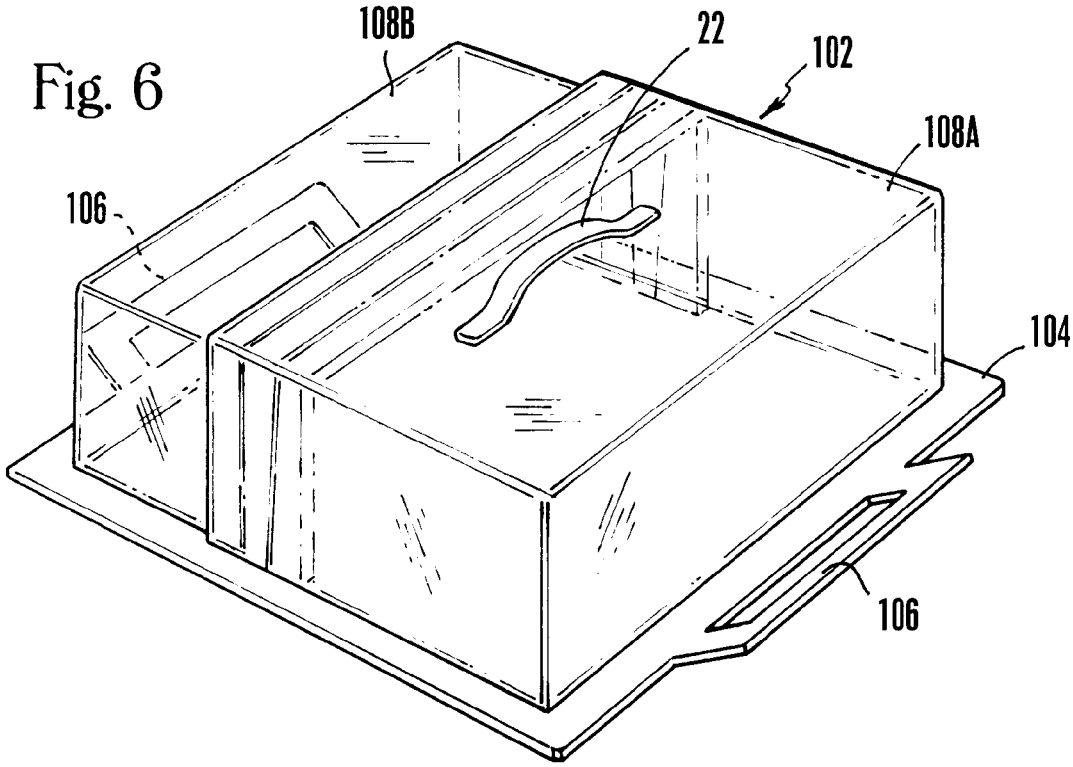
FIG. 6 is a perspective view, with portions in phantom, showing a further alternate type of covered dishware in accordance with the present invention.
Figure 7:
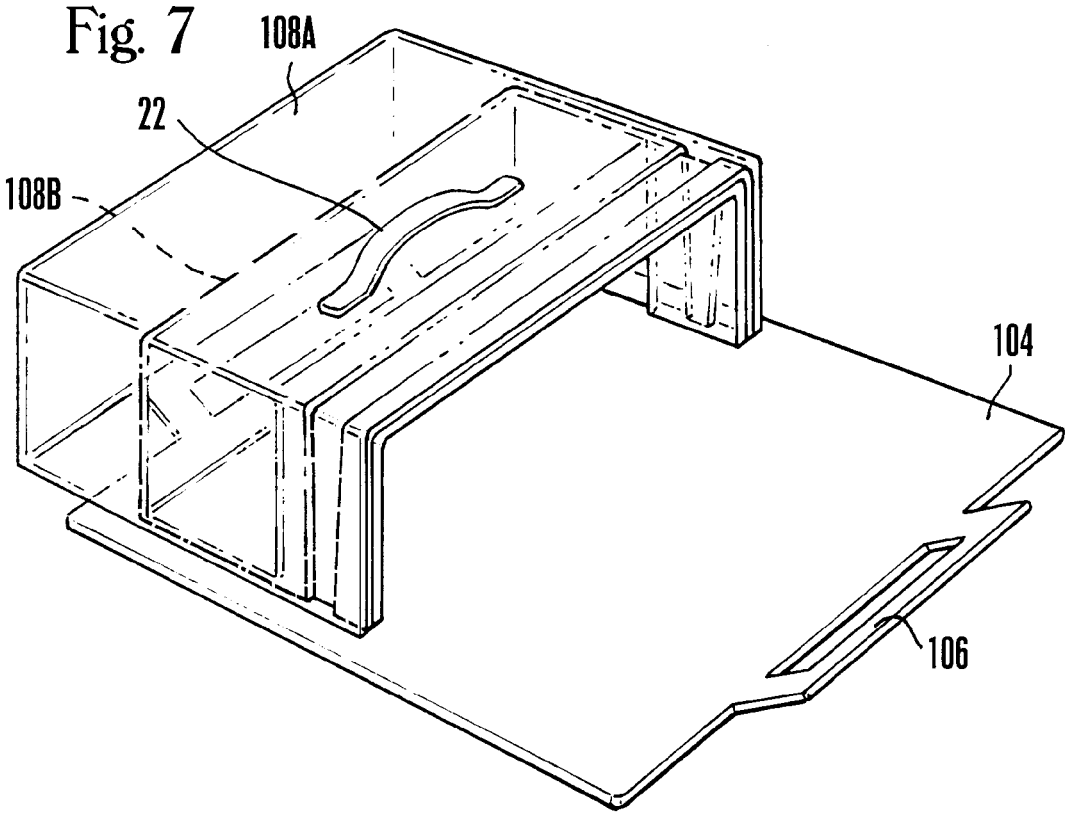
FIG. 7 is a perspective view, with portions in phantom, showing a manner of engagement between the cover and the dishware of FIG. 6 in accordance with the present invention.

A further alternate embodiment of the present invention is shown in FIG. 6, with a HALF-COVERED™ brand covered server 102 shown, having a server 104 with a pair of handles 106. A two-piece stackable cover 108A, 108B is received by the server 104, and although two are shown, it is to be understood that the present invention contemplates multiple covers. In FIG. 7, the stackable covers 108A, 108B are shown in their "stacked" configuration, with a portion of the server 104 fully exposed for ready access to whatever items have been placed thereon (none shown in the Figures).

Figures 8, 8A:
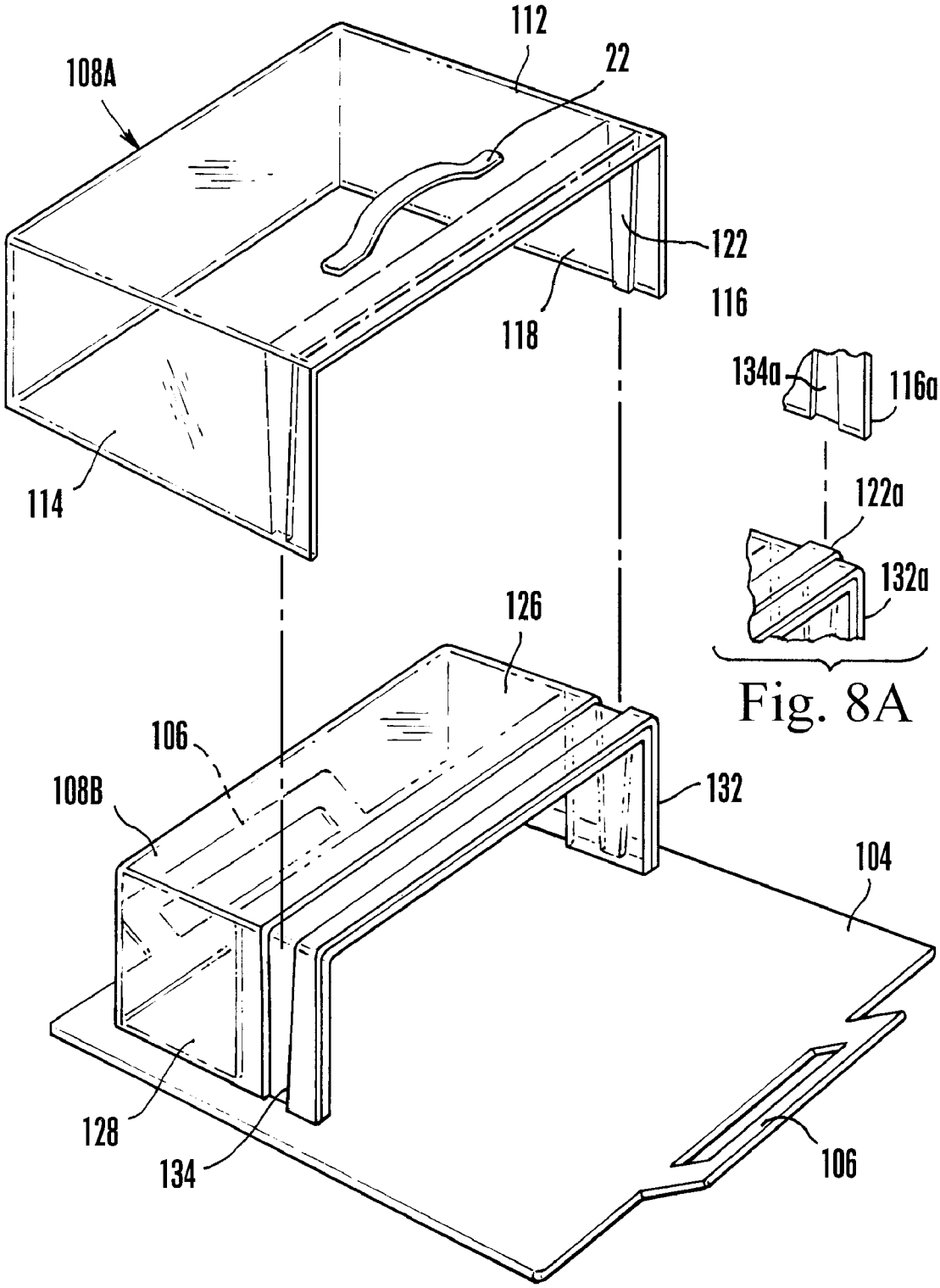
FIG. 8 is an exploded perspective view, with portions in phantom, showing a manner of engagement between the cover and the dishware of FIG. 6 in accordance with the present invention.
FIG. 8A is a partial exploded perspective view showing an alternative manner of engagement between the cover and the dishware of FIG. 6 in accordance with the present invention.

The manner in which the pair of stackable covers 108A, 108B are placed in the "stacked" configuration is best described with reference to FIG. 8. The first stackable cover 108A consists of a top cover 112 and a side wall 114 that is attached about a substantial portion of the periphery of the top cover 112, thereby defining a partial enclosure having an open end 116 and an interior surface 118. A rib 122 is formed in the interior surface 118, and is spaced from and runs parallel to the open end 116 of the first stackable cover 108A.

The second stackable cover 108B is likewise provided with a top cover 126 and a plurality of sidewalls 128 that also define an open end 132. An interlocking groove 134 is formed in an exterior surface of the top cover 126 adjacent the open end 132. As is depicted in FIG. 8, the interlocking groove 134 is positioned to receive the rib 122 when the first stackable cover 108A is placed on top of the second stackable cover 108B. The releasable inter-engagement of the rib 122 and the interlocking groove 134 (best shown in FIG. 7) provides stability to the stacked arrangement of the first and second stackable covers 108A, 108B. FIG. 8A depicts an alternative location of the rib and groove, where an interlocking groove 134*a* is formed adjacent an open end 116*a* of the stackable cover 108, and a rib 122*a* is formed adjacent an open end 132*a* of the server 104. Further stability is provided in a presently preferred arrangement whereby the second stackable cover 108B is physically attached to the server 104.

At such time as it is desired by a user to fully cover the server 104, the first stackable cover 108A is lifted from on top of the second stackable cover 108B, is rotated 180 degrees, and is then lowered onto the server 104. The rib 122 is once again received within the interlocking groove 134, which inter-engagement provides both structural stability and an air seal between the otherwise unconnected pair of stackable covers 108A, 108B.

In a presently preferred embodiment, the HALF-COVERED™ covered server 102 is fabricated out of plastic of thickness ¼", with such materials as metal, glass, and wood also appropriate. As fabricated in the form depicted in FIGS. 6–8, the covered server 102 may be dimensioned (for purposes of illustration) along the following lines.

The server 104 measures 18½" by 18½", with the handles 106 attached to the server 104 having dimensions 2½" by 14½". The first stackable cover 108A is 16⅝" in length, 10½" in width, and 8½" in height, with interior dimensions of 16⅜" in length and 10¼" in width. The rib 122 projects 3/16" from the interior surface, and is ¾" wide along the top cover 112 and tapers to ⅜" at the base of the sidewalls 114. The rib 112 is spaced a distance ½" from the open end 116 along the top cover 112, which increases to ⅝" at the base of the sidewalls 114.

The second stackable cover 108B measures 16" by 8¼" and is 8¼" in height. The interlocking groove 134 is ¼" in depth, at a position on the top cover 126 that is 1 inch from the open end, increasing to 1 3/16" at the bottom of the side walls 128. The width of the interlocking groove 134 is 13/16" along the top cover 126, tapering to 7/16" at the base of the side walls 128.

A still further alternate embodiment of the present invention is shown in FIG. 9, with a TWIST-A-COVER™ brand covered dish 152 that includes a dish 154 with a pair of dish handles 156 and a cover 158. A cover handle 162 is attached to a central portion of the cover 158 with a center support 164 extending from a central location in the dish 154 up to the cover 158.

The manner in which the center support 164 provides a platform to support the cover 158 is further illustrated in FIG. 10A. The center support 164 concentrically receives a support shaft 168 that extends downwardly from the inner surface of the cover 158 adjacent to the cover handle 162. The support shaft 168 terminates in a plurality of separate, laterally projecting support feet 172 (two are shown in FIG. 10).

A plurality of cam surfaces 174 extend from an inner wall of the center support 164. As is best shown in FIG. 10B, the cam surfaces 174 terminate short of the cover 158, forming a first locking passage 182 for the support feet 172. The locking passage 182, located adjacent the cover 158, is further defined by a plurality of support shaft stops 184 that are attached to and project from an inner surface of the center support 164.

In FIG. 11A the interrelationship of these various members is shown, with the support feet 172 shown in the locking passage 182 in a location that permits either insertion or removal of the support shaft 168 from the center support 164. The support feet 172 have been rotated within the locking passage 182 to a position that is vertically above the cam surfaces 174 and vertically adjacent the support shaft stops 184. As so positioned, the support shaft stops 184 do not prevent either the insertion or the removal of the support feet 172 from within the center support 164.

In contrast, in FIG. 11B the position of the support feet 172 has been rotated within the locking passage 182 to a position vertically below the support shaft stops 184. As so positioned, the support feet 172 are prevented from being removed from the center support 164. In this position, however, the cam surfaces 174 permit the vertical movement of the support feet 172 within the center support 164. It is in this position that the cover 158 can be raised and lowered with respect to the dish 154.

Figure 10C:
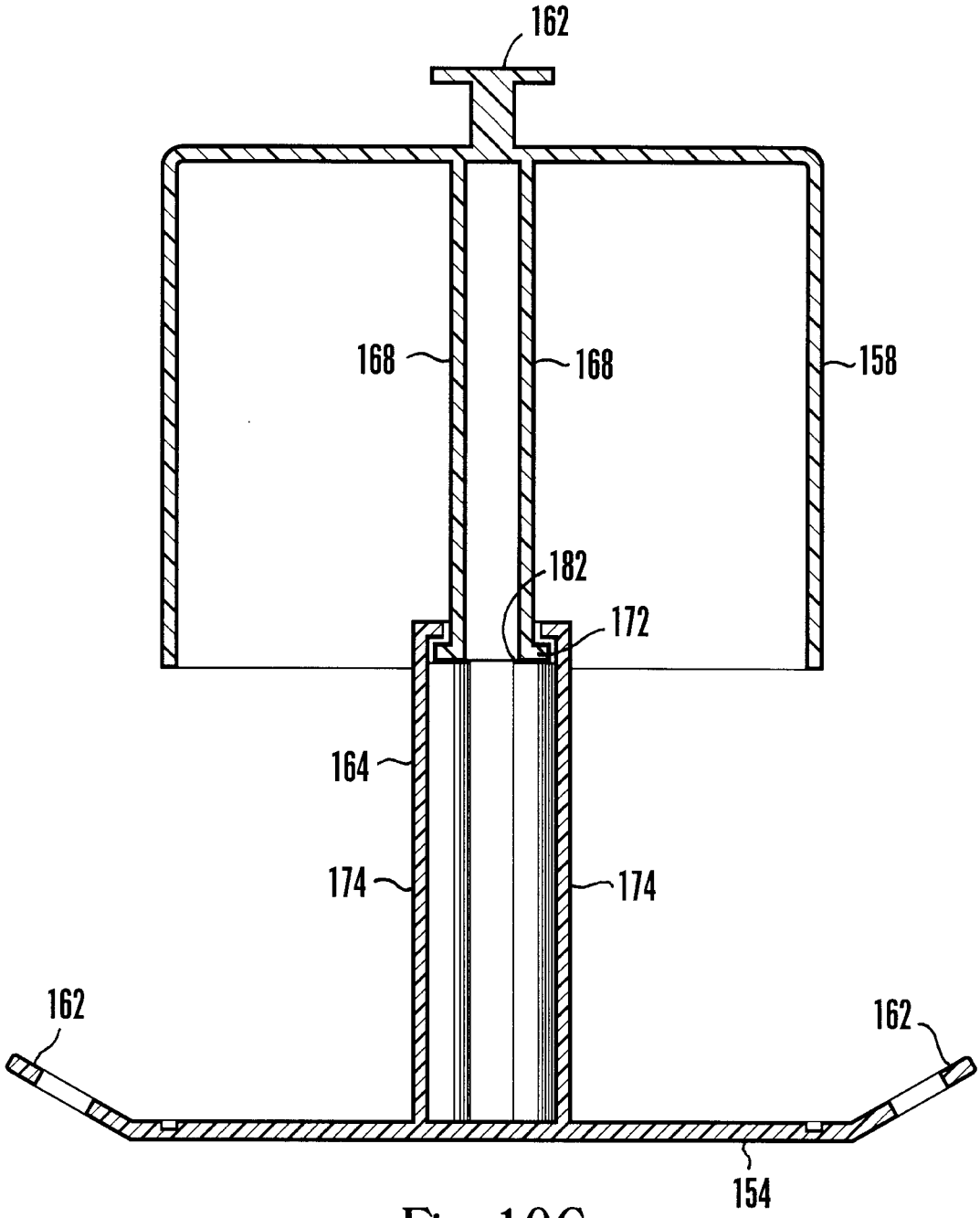
FIG. 10C is a cross-sectional view, taken along line 10—10 of FIG. 9, showing a manner of engagement between the cover and the dishware of FIG. 9 in accordance with the present invention.

Turning now to FIG. 10C, the cover 158 is shown as suspended above the dish 154, with the support feet 172 having been rotated within the locking passage to overlie, and be supported by, the upper end of the cam surface lobes 174. This rotated position of the support shaft 168 is equivalent to that shown in FIG. 11A. From this position, if a further lifting force were to be applied to the cover handle 162, the cover 158 would become separated from the center support 164 and the dish 154.

In a presently preferred embodiment, the TWIST-A-COVER™ covered dish 152 is fabricated out of plastic of thickness ⅛" and 3/16", or alternatively such materials as metal, glass or wood. For purposes of illustration, when fabricated in the form depicted in FIGS. 10 A–C and 11A and 11B, an appropriate set of dimensions is discussed in the following.

The cover 158 is circular, with a diameter of 10" and a height of 9¼", and matches a dish having a diameter of 11¾". The center support 164 extends upward from the dish 154 a distance of 9", and is 2¾" in diameter. The support shaft 168 extends downwardly from the cover a distance of 8-7/16" with a diameter of 1½". The cam surface lobes 174 project out from the inner surface of the center support 164 a maximum distance of ½". The support feet 172 project from the outer surface of the support shaft 168 a distance of 7/16", thus providing an interference fit when juxtaposed adjacent the cam surface lobes 174. In a like manner, the support shaft stops 184 project a distance of ⅜" from the inner surface of the center support 164, and in a presently preferred embodiment, there are four equally-spaced cam surface lobes 174 and support shaft stops 184, with the latter 45 degrees out of phase with the former.

The first locking passage 182 need only provide space within which the support feet 172 rotate about the support shaft 168, and with the support feet 172 having a thickness of ¼" and projecting from the support shaft 168⅜" inches, a distance of ⅝" for the first locking passage 182 is deemed to be adequate.

Figure 12:
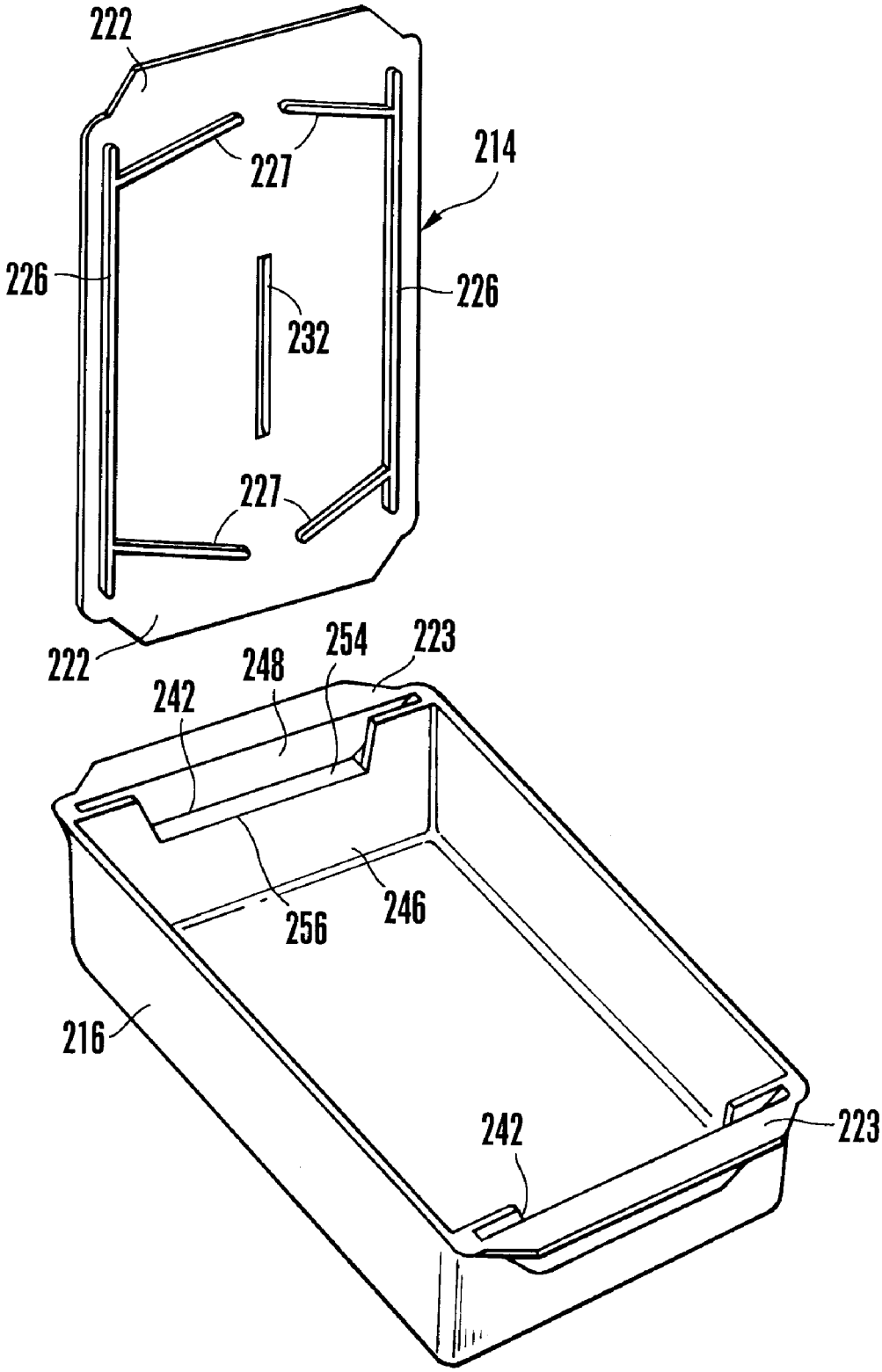
FIG. 12 is an exploded perspective view, similar to FIG. 2A, showing an alternative embodiment of a covered container and a manner in which a cover engages with the container in accordance with the present invention.

FIG. 12 depicts a design variation on the STAND-A-COVER™ brand covered pan with a cover 214 that has been removed from a lower pan 216 and is now positioned to be received by the lower pan 216 for temporary storage. To assist in carrying the covered pan, a handle extension 222 is formed at each end of the cover 214, with a corresponding handle extension 223 formed at each end of the lower pan 216. When the cover 214 lies on top of the lower pan 216 (not shown, but similar to FIG. 1), the cover handle extensions 222 overlie the lower pan handle extensions 223 to collectively form end handles for the covered pan.

The inside surface of the cover 214 is provided a seating ridge 226 that extends along each lateral side of the cover 214 a distance that substantially corresponds to the inside length of the lower pan 216. A pair of channel guides 227 project inwardly from each of the seating ridges 226 at each end of the cover 214. These features serve to direct the flow of any condensate that may form on the bottom surface of the cover 214 (formed by warm foods or the like) as the cover 214 is placed in near-vertical position just prior to its storage in the lower pan 216. The inner surface of the cover 214 is also provided a central support rib 232 to provide additional structural rigidity to a handle for the cover 214 formed on the outer surface at that same central location (not shown in the Figures).

A retaining slot 242 is formed at each end of the lower pan 216, and each are configured to temporarily receive and retain either of the cover handle extensions 222. An inner retaining wall 246 is located at each end of the lower pan 216 and is spaced from an outer retaining wall 248, which in turn forms each of the outer end walls of the lower pan 216. The inner retaining walls 246 are sufficiently spaced from their corresponding, adjacent outer retaining walls 248 to receive either of the cover handle extensions 222.

The slot formed between the inner retaining wall 246 and the outer retaining wall 248 does not extend the entire distance to the bottom of the lower pan 216, instead a raised edge support surface 254 is formed at a depth sufficient to receive an outer edge of the cover handle extension 222 with the retaining slot 242 retaining the cover 214 in a secure manner. In addition, the height of the inner retaining wall 246 is not uniform, being higher adjacent the outer walls of the lower pan 216 and lower in the middle section, thereby forming a drainage channel 256. This feature considerably simplifies cleaning and sanitation by preventing the accumulation of food in the bottom of the retaining slot 242.

When fabricated in the shape of FIG. 12, appropriate dimensions for a pan measuring approximately 9 inches by 10 inches, and 3 inches in height (not including the cover handle 1 inch in height). The corresponding cover would have dimensions of 9 inches by 13 inches each of the cover handle extensions projecting approximately 1 inch beyond the inner container to form the handle as well as the portion that extends into the slot for temporary storage.

My invention has been disclosed in terms of a preferred embodiment thereof, which provides improved covered dishware that are of great novelty and utility. Various changes, modifications and alterations in the teachings of the present invention may be contemplated by those skilled in the art without departing from the intended spirit and scope thereof. It is intended that the present invention encompass such changes and modifications.

What is claimed is:

1. In a food container having a removable cover with a first cover support, said first cover support and a surface of said food container forming a sealed relation, the improvement comprising:

a secondary cover support formed in said removable cover; and a secondary mounting platform formed in said food container, said mounting platform of a configuration to receive and selectively retain said secondary cover support of said removable cover in a manner exposing a substantial portion of said food container to outside access.

2. A food container according to claim 1, wherein said container and said removable cover are substantially circular, said container further comprising:

a support shaft attached to an inner surface of said removable cover and extending along a central axis thereof; and a center support attached to an upper surface of said food container an extending along a central axis thereof, said center support having a diameter greater than a diameter of said support shaft and receiving said support shaft upon placement of said removable cover on said food container.

3. A food container according to claim 2, and further comprising:

a plurality of support feet extending outwardly from said support shaft at a location substantially adjacent an outer terminus thereof; and a plurality of cam surface lobes extending inwardly from an outer circumference of said center support, whereby said plurality of support feet are received within a corresponding plurality of passages formed within said center support by said plurality of cam surface lobes.

4. A food container according to claim 3, wherein said plurality of cam surface lobes are spaced from an outer terminus of said center support and further comprising:

a plurality of support shaft stops projecting inwardly from said outer circumference of said center support at said outer terminus thereof, forming a locking passage free of inward projections between said cam surface lobes and said support shaft stops.

5. A food container according to claim 4, wherein said plurality of cam surface lobes are identical in number to said plurality of support shaft stops.

6. A food container according to claim 5, wherein said plurality of cam surface lobes are radially offset from said corresponding plurality of support shaft stops.

* * * * *